United States Patent [19]

Reese

[11] Patent Number: 4,488,686

[45] Date of Patent: Dec. 18, 1984

[54] APPARATUS AND METHOD FOR PACKAGING A PLURALITY OF FILAMENTS OR BUNDLES OF FILAMENTS

[75] Inventor: Walter J. Reese, North Huntington, Pa.

[73] Assignee: PPG Industries, Inc., Pittsburgh, Pa.

[21] Appl. No.: 456,886

[22] Filed: Jan. 10, 1983

[51] Int. Cl.[3] ..... B65H 54/08; B65H 55/00

[52] U.S. Cl. ..... 242/18 G; 242/42; 242/43 R; 242/166; 242/157 R

[58] Field of Search ..... 242/18 G, 18 R, 42, 242/43 R

[56] References Cited

U.S. PATENT DOCUMENTS

| | | | |
|---|---|---|---|
| 2,345,544 | 3/1944 | Worthington | 242/42 |
| 3,365,145 | 1/1968 | Klink et al. | 242/166 |
| 3,367,587 | 2/1968 | Klink et al. | 242/18 |
| 3,371,877 | 3/1968 | Klink et al. | 242/18 |
| 3,498,550 | 3/1970 | Klink et al. | 242/18 |
| 3,547,361 | 12/1970 | Klink | 242/18 |
| 4,167,252 | 9/1979 | Klink et al. | 242/18 G |
| 4,322,041 | 3/1982 | Schuller et al. | 242/42 |

*Primary Examiner*—Stanley N. Gilreath

*Attorney, Agent, or Firm*—Kenneth J. Stachel

[57] ABSTRACT

An apparatus, method and package are provided for producing and winding bundles of filamentary material to achieve good split efficiency of removal of the plurality of bundles from the package for further processing, and to produce a package of wound bundles of filaments having good edges.

The apparatus has a filament forming means, gathering means to gather the filaments into a plurality of bundles of filaments, rotatable winder to attenuate and wind the bundles, traversing guide, reciprocating means, and contacting means. The traversing guide has angularly opposing sides that converge to meet and extensions protruding from each angularly opposing side to subtend partially the point of convergence of the angularly opposing sides. The extensions do not meet each other to form an opening for placement of the bundles into the containment area formed by the angularly opposing sides and extensions. The traversing guide deposits the bundles of filaments in essentially uncrossed, side-by-side relation, and cooperates with the contacting means at each end of a layer to deposit the bundles in grouped relationship.

20 Claims, 12 Drawing Figures

APPARATUS AND METHOD FOR PACKAGING A PLURALITY OF FILAMENTS OR BUNDLES OF FILAMENTS

BACKGROUND OF THE INVENTION

This invention relates to an apparatus and method for producing packages of filaments, strands and the like.

More particularly, this invention is directed to an apparatus and method for producing packages having a plurality of bundles of continuous filaments so that the package has neat edges and facilitates the removal of the distinct bundles of filaments from the package.

In the manufacture of continuous filaments or strands, the packaging of these materials to facilitate the removal of the continuous materials for use in sundry processes is an important aspect in their manufacture. Generally, when continuous filaments or strands are produced they are wound onto a package, and the package of filaments or strands is used subsequently to produce various manufactured products. The filaments or strands must be easily movable from their packages to have an efficient operation in producing manufactured products, and this is particularly important for multistrand packages. In addition, a package of continuous filaments or strands containing a plurality of distinct filaments or distinct strands should have neat edges and not featheredges at the ends of the package. A feather-edge package is detrimental to removing the distinct filaments or strands for further processing, since this type of package contains groups of filaments or strands in which one filament or strand of an array is wrapped on a substantially larger or smaller diameter of the package than another filament or strand in the same array. When this type of package is unwound different lengths of the filaments or strands would be obtained. This difference in length is commonly referred to as catenaries. The catenaries can cause looping and snarling in the processing of the continuous filaments or strands from the package into manufactured products. Also the feather-edge type package presents a greater risk for damage occurring to the continuous filaments and/or strands at the edge of the package during shipment of the packages. Any damage to the continuous filaments or strands at the ends of the packages could result in broken filaments or strands engendering difficulties when the filaments are removed from the package. The feather-edge package usually has a larger diameter in the center of the package than the diameter at the ends of the package. An extreme uneveness in the diameter of the package requires the controlled use of additional devices in winding such a package so that the guide used to traverse the continuous filaments or strands onto the package continuously moves away from the building package. This movement prohibits the building package from touching the traversing guide.

In the manufacture of continuous glass fibers and/or strands, a roving can be produced, which is a cylindrically shaped package of one or more bundles of glass fibers wound in parallel. Traditionally, these roving packages have been produced by mounting a plurality of packages of glass fiber strands that were produced in forming the glass fiber strand on a creel or support and gathering the plurality of strands in a parallel array and winding these strands onto a cylindrical package.

Recently it has become a standard practice in the industry to produce a cylindrically shaped package of bundles of glass fibers during the formation of the glass fibers. This directly wound package has at least flat surfaces and at least nearly square edges on both ends of the packages. Such a directly wound cylindrical package of strand has the benefit of being made on a large scale in one operation, i.e. starting with the glass making raw materials and finishing with a cylindrical package sometimes referred to as a roving package that is ready for packaging and shipment.

Reportedly, a direct drawn roving package has been developed to take full advantage of even tensioning of glass fibers that are to be used in reinforcing polymeric materials. This is reported at pages 261 through 263 in "The Manufacturing Technology of Continuous Glass Fibers", by K. L. Lowenstein, Elsevior Scientific Publishing Company, Amsterdam, The Netherlands, 1973. In the production of roving packages, the lay of the strands in the successive layers making up the package is important to achieve the desired dimensions of the package. Also, the lay of the strands is important in roving packages in removing the strands from a roving package to use the strands for various applications, such as the formation of continuous strand mat, or the chopping of the strands to produce chopped glass fibers for reinforcement of polymeric and/or elastomeric materials, and/or the production of chopped strand mats. The ability to obtain the same number of distinct strands out of the wound roving package as were placed into the wound roving package during processing is an important parameter to the efficiency of further process operations. This ability is referred to as the splitting efficiency, which is defined in the book "The Manufacturing Technology of Continuous Glass Fibers" at pages 181 and 182 as the number of substrands formed expressed as a percentage of the number that should have been formed. The determination involves counting the number of substrands in a sample of known weight. The splitting efficiency can be found by the formula: $NLT \div 10^4 ws$ %. Where N is the number of substrands formed in a sample of a specific weight, L is the chopping length and T is the tex of the whole strand and w is the weight and s is the intended split of the strand.

It would be beneficial to both the producer and user of glass fiber strand to produce glass fiber strands in a multistrand, roving package produced directly in drawing the glass fibers, where the direct drawn roving packages have a good shape and a good split. To this end, the art has made numerous attempts to commercially produce a multiple strand, directly drawn roving product, but currently such a product is not readily available in the marketplace.

An early attempt discussed in U.S. Pat. No. 3,365,145 involves the use of a traversing device with a sensing means along with projections from the traversing device having pins which contact the edge of the layers of strands being wound so that the edge of the layer of a plurality of strands is forced into a straight edged package.

Another approach disclosed in U.S. Pat. No. 3,371,877 (Klink et al.) involves the use of a traversing device having a guide, which is a comb, wherein in each slot of the comb a single strand is located for placement of the strands in side-by-side array in the layer on the wound package. Above the comb on either end of the traverse are studs upon which the strand impinges at the end of each traverse to provide edge control in building up the successfully layered package. As is shown in the patent at FIG. 6, this edge control still allows the strands coming from the comb to remain in side-by-side relationship. Underneath the comb receiving the strands coming from the comb is a T-shaped slotted device acting as a sensor and guide member as the strands are wound in side-by-side relation onto the package.

A more recent approach is disclosed in U.S. Pat. No. 4,322,041 (Schullar et al.) which discloses the use of a traverse guide member which is used in very close proximity to the package of continuous multiple strand material being wound. The strand traverse guide is a vertical concave device with a V-shaped slot. The plurality of strands ride as separated strands on one or the other of the sloping sides of the V-shaped slot depending upon which direction the strand traversing guide is being traversed. The strand traversing guide also has a surface portion beneath the V-shape slot, which contacts all the strands and is in intimate contact with the rotating winder upon which the package is wound. This allows the strands to be wound on to the package almost immediately after contacting this surface portion of the guide.

It is an object of the present invention to provide an apparatus and method for producing a wound cylindrical package of a plurality of distinct filaments or distinct bundles of filaments, where the package has a neat appearance to reduce the risk of damage to the strands in the package during shipping, and, where the package has a good split efficiency in removing the distinct filaments or distinct bundles of filaments from the package for further processing.

It is a further object of the present invention to provide a traversing guide for linear filamentary material that is useful for various winding and traversing apparatus to produce a package of wound continuous filaments or strand having a reduced risk of damage to any of the strands in the package and having a good split efficiency with the distinct filaments or distinct strands in side-by-side relation to each other for the majority of the length of the successive layers in the package but having grouped relationship at the ends of the package.

It is another further object of the present invention to provide a package of wound filaments or strands having a plurality of distinct filaments or strands wound in successive layers, where the distinct filaments or distinct strands are in side-by-side relation to each other for the majority of the length of each layer, but exist in a grouped relation to each other at both ends of the cylindrical package to facilitate a neat package to reduce the risk of damage to any of the strands in the package during shipment and to allow for good split efficiency in removing the plurality of distinct filaments or distinct strands from the package for further processing.

SUMMARY OF THE INVENTION

In accordance with the instant invention a plurality of filaments or a plurality of bundles of filaments or strands can be produced and collected by an apparatus having: a means for forming a plurality of the continuous filaments from a supply; a means for gathering the plurality of filaments into more than one bundle of continuous filaments; a rotatable winder to collect the more than one bundle of continuous filaments; a traversing guide with a containment area to engage the bundles of filaments and to guide them onto the rotating winder to produce successive layers of bundles of filaments, a reciprocating means mounted to the traversing guide so that the traversing guide is approximately horizontally positioned to reciprocate the traversing guide with the bundles of filaments to form the layers of filaments on the rotating winder, and contacting means mounted so that the bundles of filaments contact the means at a location aligned at or near each end portion of the layers on the rotating winder.

The means for forming the plurality of continuous filaments can be any means used for forming filaments; for example, in forming glass filaments the means can produce streams of glass flowing from a supply of heat softened fiberizable glass batch material and apply a chemical material to the surface of the filaments. The means for gathering the filaments into the bundles can be any means to bring more than one filament together to form a bundle and such means is usually located a sufficient distance from the means for forming the filaments to allow the filaments to cool to a temperature at which they can have the chemical material applied to them before they are gathered. The rotating winder collects the continuous filaments and attenuates the continuous filaments from the supply of heat softened material and supports a successively layered cylindrical package of the continuous filament. For example, in forming glass filaments the rotatable winder attenuates the continuous glass filaments from the supply of heat softened, fiberizable, glass batch material that issues the streams of flowing glass.

The traversing guide is formed by two opposing nonparallel sides at angular relation to each other converging to form a corner. The corner may be rounded or angular. The angle formed at the corner or from the extensions of the converging sides to the vertex of the angle, if the corner is rounded, is greater than zero degrees and less than 180 degrees. The traversing guide also has an extension from the farthest divergent end of each opposing nonparallel, converging side, so that each extension approaches the other in order to partially subtend the corner formed by the two opposing, nonparallel sides. Each extension forms a corner with the respective opposing, nonparallel, converging side to which it is attached. These corners, which may be round or angular, form an angle from greater than 0° up to less than 135°. The two opposing, nonparallel, sides and the two extensions encompass the containment area. The two extensions do not meet each other so that an opening is formed into the containment area. The opening permits bundles of filaments to be placed in the containment area, and the location of the opening retards the exiting of the bundles of filaments out of the opening and from the containment area during traversing. The plane of the two angular opposing sides and the two extensions can be the same plane, or one or more of the sides or extensions can be in different planes. Also the sides could be overlapping in different horizontal planes to form the containment area. Generally, the containment area can have a V-shape, semicircular shape or semieliptical shape or any other shape resulting from two converging, nonparallel sides having extensions that approach each other from the most distal point of divergence of the converging sides so as to partially subtend the angle formed by the converging sides.

The reciprocating means traverses the traversing guide linearly along the axis of rotation of the rotatable winder to distribute the bundles of filaments in successive layers on the rotating winder to form the essentially cylindrical package of successive layers of bundles of filaments. The traversing guide is mountable on the reciprocating guide in an approximately horizontal position, where the degree of variation from the horizontal position can be up to around 45° in an upward or a downward direction. The approximately horizontally positioned traversing guide, when reciprocated, places the bundles of filaments onto the rotating winder in substantially side-by-side relation to each other for a majority of the linear length of each layer parallel to the axis of rotation of the winder and with coaction from the contacting means in grouped relation at both end portions of each layer. Successive layers of this pattern are built up to produce an essentially cylindrical package.

The contacting means is located to contact the bundles of filaments nearly adjacent to the ends of the layers formed on the winder so that the bundles contact the means as the traverse guide moves past the contacting means and the bundles of filaments are gathered into a group at the proximate corner of the traverse guide in relation to the center of the layer. This grouping of the plurality of bundles of filaments is guided by the traversing guide in concert with the contacting means onto the end portion of the layer on the winder as the group of bundles.

Another aspect of the present invention is a method for collecting a plurality of continuous filaments or a plurality of bundles of continuous filaments into a wound package having successive layers on a rotating winder. This method is accomplished by supplying the plurality of continuous filaments, gathering the continuous filaments into a plurality of bundles of continuous filaments, traversing the plurality of bundles of continuous filaments linearly in relation to the axis of rotation of a rotating winder so that the plurality of bundles contact the rotating winder and are deposited on the rotating winder as a layer, and winding a successive number of layers of the plurality of bundles on the rotating winder to form a cylindrical package. The traversing of the plurality of bundles of continuous filaments places the continuous filaments in side-by-side relation to each other for a majority of the length of the layer parallel to the axis of rotation of the winder. At the end portions of each layer, the plurality of bundles of continuous filaments are deposited as a group of bundles of continuous filaments.

A further aspect of the present invention is a wound package having successive layers of a plurality of bundles of continuous filaments, where the orientation of the bundles in the central portion of each layer is in a side-by-side, uncrossed, spaced apart relation for a majority of the linear length of the layer parallel to the central axis of the cylindrical package. At the end portions of each successive layer the plurality of bundles of continuous filaments are in a group of bundles of continuous filaments. The wound, essentially cylindrical package has end portions that are slightly greater in diameter than the diameter of the central portion of the package, where the bundles of filaments are wound in side-by-side spaced apart relation. The nearly cylindrical package of wound bundles of continuous filaments has neat square edges and the split efficiency upon removal of the plurality of bundles from the package is greater than 75 percent and somewhat less than 100 percent.

BRIEF DESCRIPTION OF THE DRAWINGS

The apparatus, method and package of the present invention will be more fully described in respect to the attached drawings in which.

DETAILED DESCRIPTION OF THE DRAWINGS

While the apparatus, method and package of the present invention are particularly suitable for forming filaments of heat-softened, fiberizable material such as glass for producing glass fibers and producing multistrand roving of the glass fibers, in the broadest aspect of the present invention, the apparatus and method may be utilized for producing packages, and particularly roving packages, of filamentary materials other than glass. The following disclosure will be directed to the formation and winding of a plurality of glass fiber bundles having continuous glass fiber filaments, although such disclosure is not limited to the type of filaments that can be formed and wound by the apparatus of the present invention using the method of the present invention to produce the package of the present invention as aforementioned.

Figure 1:
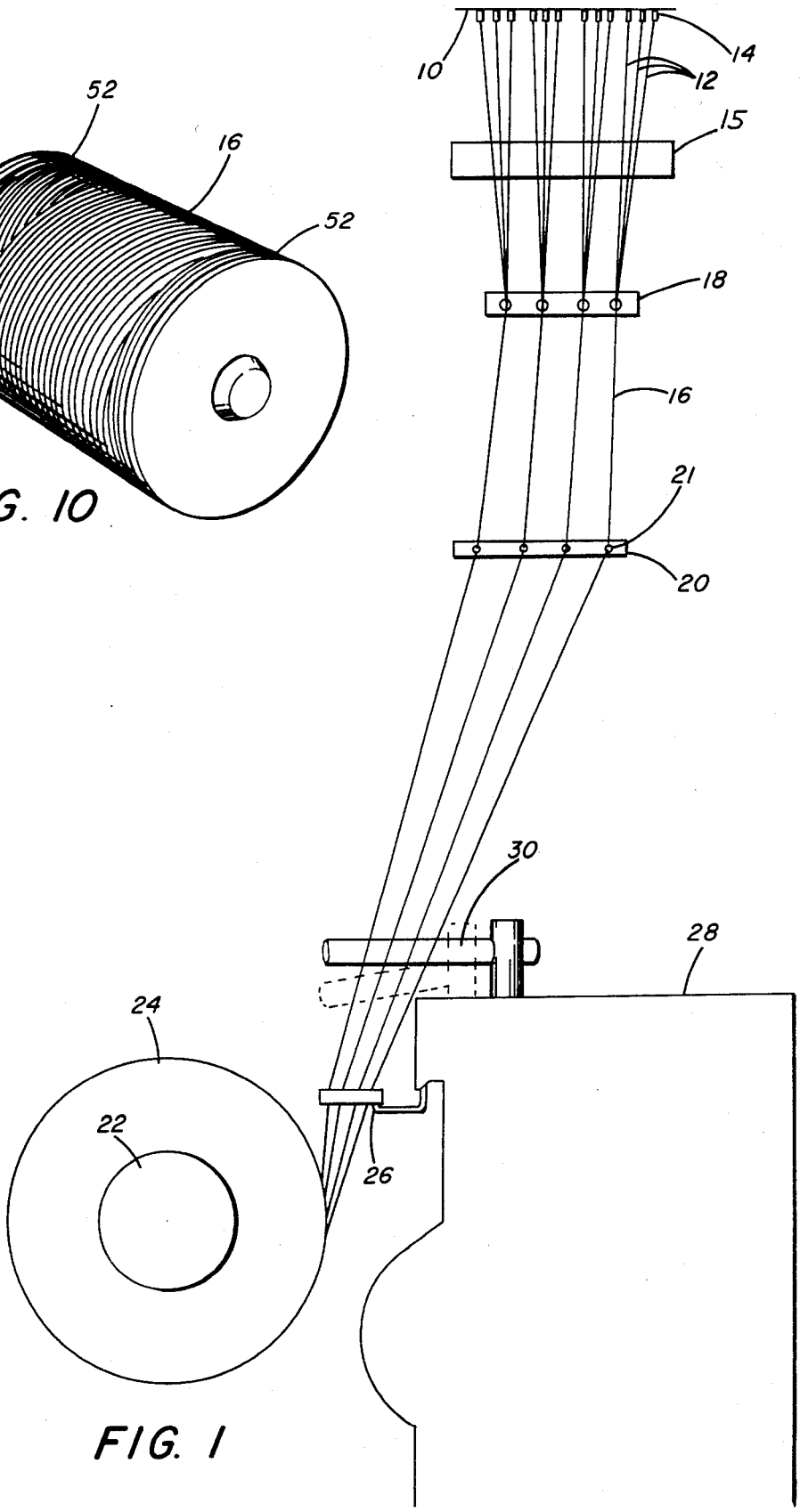
FIG. 1 is a view taken in front elevation of an apparatus for forming and winding a plurality of bundles of continuous filaments into an essentially cylindrical package having successive layers of the plurality of bundles of continuous filaments.

Referring initially to FIG. 1, there is illustrated a fiber forming apparatus generally designated as numeral 10 from which glass fibers, numeral 12 are drawn or attenuated from cones of heat softened glass suspended from tips, 14 in the openings of the bottom of the bushing 10. The bushing may, for example, have 40 pairs of rows with 25 tips in each pair of rows so that about 2,000 fibers can be simultaneously drawn from the tips in the bushing 10. From each of the pairs of rows around 50 to 1,000 fibers are gathered and formed into more than one bundle of fibers each designated by numeral 16. These bundles of fibers are formed by gathering the filaments 12 in gathering shoe 18. The gathering shoe can be any device known to those skilled in the art for gathering filaments into bundles of filaments or into strands, a nonexclusive example of which is a rotatable gathering shoe, which is usually made of graphite. Another nonexclusive example is a stationary shoe or comb, which can be made of graphite or cotton and phenolic resin laminate, such as micarta or reinforced phenolic laminates. Before the fibers are gathered into one or more bundles of fibers, the fibers are passed in contact with an applicating device, 15, to supply the fibers with a coating of chemical material over a substantial portion of their surfaces. The coating usually has a carrier such as water or an organic liquid and may have one or more coupling agents and/or binder solutions having one or more film forming polymers and/or one or more lubricants, surfactants, emulsifiers and the like.

Although FIG. 1 indicates that four bundles or strands, hereinafter referred to as strands, can be formed from the illustrated number of fibers, the present invention is not restricted to operation with four strands, but is particularly useful for simultaneous winding of greater numbers of strands, for example, 12 strands or even more. The number of strands generally varies from 2 to more than 12.

The strands, 16, from the gathering or splitting device 18 travel downwardly. In a double level operation the strands travel along divergent paths established by bar 20, which has a plurality of guides 21 to accommodate the number of strands so as to direct the strands further downward to converge at the winder after passing through the traversing device 26 for disposition onto a rotating winder, mandrel or collet 22. Bar 20 is needed in a double level operation because the glass fibers travel a distance from the bushing to the point of being wound onto a package, which is the distance of two operating floors (not shown). In the double level operation, the distance between the bushing nozzles and the axis of the winder is generally around 3.5 to 4 meters. The bar 20 separates the strands from each other a sufficient distance so that when the strands pass through the traversing device the converging paths of the strands still allow for some separation at the traversing device. In a single level operation, where the distance between the nozzles of the bushing and the axis of the winder is around 2 to about 2.5 meters, the bar 20 is not necessary because the converging paths of travel of the strands usually naturally allows for such a separation of the strands at the traversing device. In the double level operation, if the strands are not adequately separated from each other at the traversing guide 26, the holes or hooks 21 in bar 20 are separated further from each other to cause the strands to diverge to a greater extent. This further divergence of strands increases the length of the point of convergence downwardly away from bar 20, and permits an increase in the separation of the strands at the traversing guide 26. If less separation of the strands at the traversing guide 26 is desired, the holes or hooks 21 that contain the strands are moved closer to each other. Generally, the strands on either end of bar 20 can be moved outwardly from the center of the bar to a distance, where the angle formed in the strand between the ingressing strand segment and the egressing strand segment to bar 20 can be up to around 90°.

As the strands travel downwardly in converging paths to winder 22, which provides the force of attenuation for the fibers from bushing 10 and which also winds the strands into a package 24, the strands are guided in traversing manner by traversing guide 26. The winder may be any conventional winder known to those skilled in the art. The winder is rotated generally by a winder motion (not shown) in a clockwise direction. The traversing guide is movably attached to reciprocating means 28, which may be any reciprocating means with a conventional drive means and means for converting rotational motion to linear reciprocating motion known to those skilled in the art, for example, like that disclosed in U.S. Pat. No. 3,998,404 (Reese) hereby incorporated by reference. The operation of the reciprocating means 28 causes the traversing guide 26 to move the converging strands back and forth in a direction parallel to the axis of rotation of the winder so that the strands are deposited on the winder to form a layer across the peripheral surface of the winder. As the traversing guide comes to the end of each stroke and the reciprocating means reverse, the strands hit contact means 30 shown in FIG. 1 or a contact means located at the opposite end of the stroke not shown in FIG. 1 but shown in FIG. 2.

The winder and reciprocating means generally interact so that one or both move away from each other as the layers of strands build up on the winder. This movement precludes any substantial contact between the traversing guide 26 and the outer layer of package 24. Any conventional mechanism known to those skilled in the art for effecting this movement can be used. For example, the mechanism in the reciprocating device of U.S. Pat. No. 3,998,404, hereby incorporated by reference, may be used or a movable winder and reciprocating means used in conjunction with an air sensing device like that of U.S. Pat. No. 4,244,533, hereby incorporated by reference, may be utilized. Also a spring sensing mechanism associated with the traversing guide and reciprocating means as known by those skilled in the art may be used to move the traversing guide and the reciprocating means away from the rotating winder.

Figure 2:
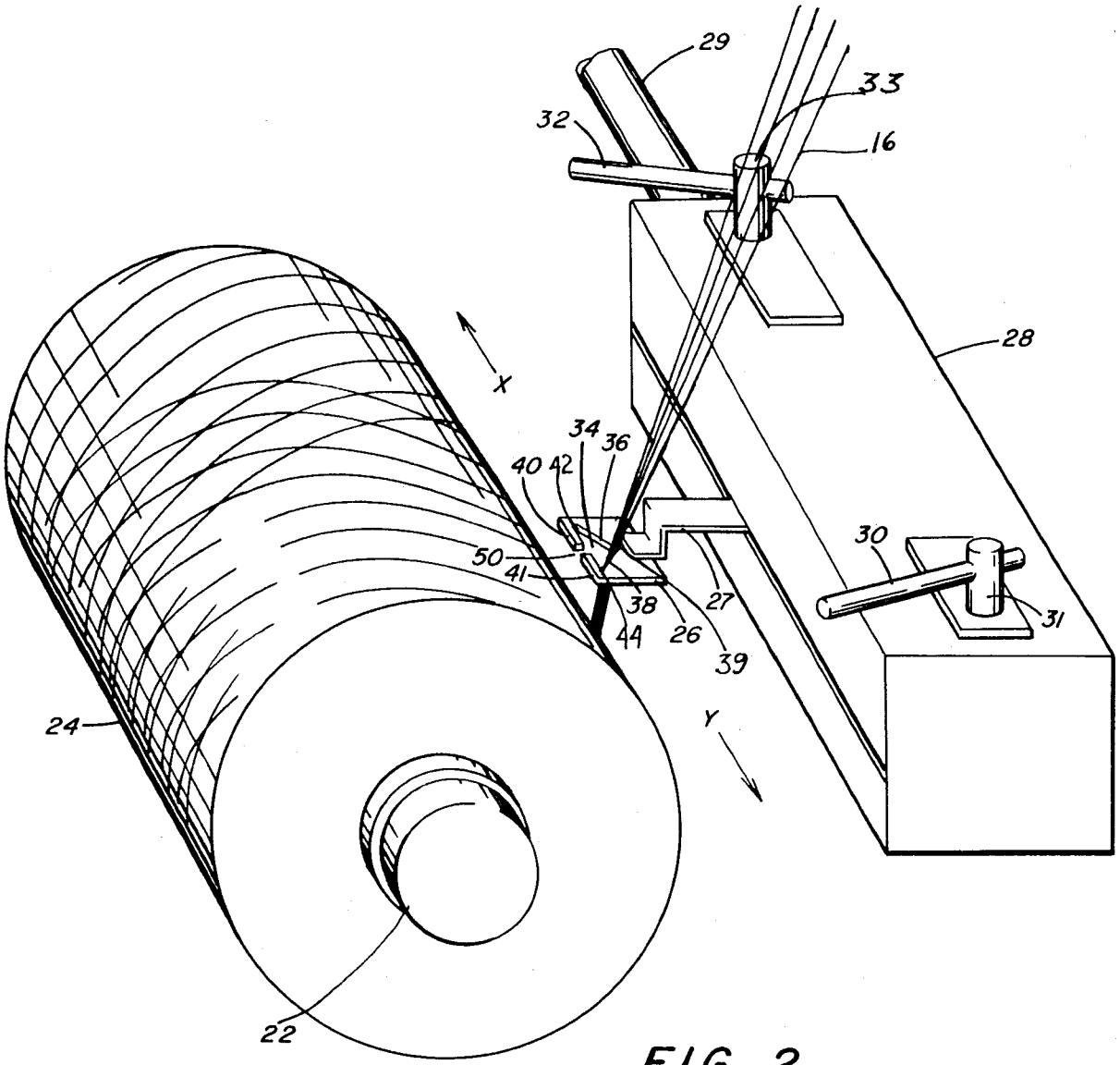
FIG. 2 is an enlarged isometric view of the winder, reciprocating means and traversing guide shown in FIG. 1.

Turning now to FIG. 2, there is shown an isometric side view of winder 22, package 24, traversing guide 26, reciprocating means 28 and contacting means 30 and 32. The reciprocating means 28 holds the traversing guide 26 in a near horizontal position and preferably a horizontal position so that the plurality of strands 16 can approach the traversing guide from a direction varying from an acute angle up to a perpendicular angle in relation to the guide. Generally, the geometry of the downwardly traveling filaments and strands in relation to the winder can be any geometry known to those skilled in the art. The fiber forming apparatus, gathering means, traversing guide, reciprocating means, and winder along with any applicating means and diverter means are all positioned and supported in relation to each other to obtain the proper filament and strand geometry. For example, the winder can be directly under the bushing or not directly under the bushing, but off to one side including in front of or behind the downward projections of the perimeter of the bushing.

As shown in FIG. 2, the traversing guide in a near horizontal position to the tongue 27 of reciprocating means 28 is reciprocated parallel to the axis of rotation of winder 22. The reciprocating means 28 as shown in FIG. 2 is stationary so that the winder 22 is adapted for movement away from the reciprocating means 28, as the package 24 is built up on winder 22. The reciprocating means 28 as mentioned above can be like that of U.S. Pat. No. 3,998,404 used in conjunction with the air sensing device of U.S. Pat. No. 4,244,533 (not shown). The tongue 27 is connected through appropriate linkage to rotating shaft 29 so that the rotational motion of shaft 29 is converted into the linear reciprocating movement of tongue 27.

On top of reciprocating means 28 are located attachments means 31 and 33 that support contacting means 30 and 32 respectively. These contacting means can be positioned anywhere on the reciprocating means or a separate support means so the contacting means are above or below the reciprocating traversing guide so that the traversing guide can pass partially under or over the contacting means. Preferably, the contacting means are located above the reciprocating traversing guide. Also the contacting means are located so that one is adjacent each end region of package 24. The contacting means need not be directly adjacent the end regions of package 24, but they should not be located beyond the position that is adjacent the end regions. The contacting means 30 and 32 can be located at a position somewhat short of the end regions of the package 24. Indeed the contacting means 30 and 32 should be movable so that, if desired, they can intentionally be located short of the end regions of the package 24. The location of the contacting means somewhat short of the position directly adjacent the ends of package 24 will be dictated by the type of strands being wound onto the winder. Generally, when the strands are tacky, the contacting means 30 and 32 should be at a position adjacent the edges or end regions of package 24 or slightly beyond the edges. Less tacky or nontacky strands will require the contacting means to be at a position adjacent a position on the package that is not so close to the edges of the package.

The contacting means may be constructed of any suitable material. Particularly useful materials are glass fiber reinforced resins and unreinforced resins such as polypropylene, nylon, polyester resins, epoxy resins, polycarbonate resins and the like. Also materials may be used such as hard rubber, micarta, steel, brass and graphite. The shape of the contacting means is generally a rod but any other shape may be used as long as it does not cause any abrasion to the strands.

The position of the traversing guide 26 can be some distance from winder 22, but is always slightly elevated from the point of contact between the strands and the winder. The traversing guide is in a nearly horizontal position that can vary about 45 degrees above the horizontal line to 45 degrees below the horizontal line. The distance the guide is away from the winder and the surface of the package being built during winding is that distance which will not result in the guide excessively rubbing the peripheral layer of the completed package, preferably about 2 to 20 mm.

As shown in FIG. 2, the traversing guide has a preferred triangular-shaped containment area 34 formed by two angularly opposing sides 36 and 38 and extensions 40 and 41. The containment area 34 could be shaped as a semicircle or semielipse, as shown in FIGS. 9*a* and 9*b* respectively or any similarly truncated circles or elipses. These angularly opposing sides lie in angularly opposing vertical planes, where the vertical planes and angularly opposing sides form an angle ranging from greater than 0 to less than 180 degrees. Preferably the angle is about 20° to about 100° and most preferably it is from about 35° to about 80°. The traverse guide 26 also has two extensions 40 and 41, one from each opposing side as they diverge at distal points from the angle or corner 39 formed by the angularly opposing sides so that the extensions partially subtend said angle or corner. The extension 40 and 41 and opposing side to which the extension is attached 36 and 38, respectively, form corners 42 and 44 respectively. The two extensions can lie anywhere in a vertical plane which subtends the angle formed by the two angularly opposing sides 36 and 38 so that the corners 42 and 44 formed between the extensions 40 and 41 and the respective angularly opposing sides 36 and 38 vary in degree value from greater than 0° to around 135° and preferably from about 30° to about 90° and most preferably from about 45° to about 75°. The corners 42 and 44 can be rounded corners, where projections of the angularly opposing sides meeting the extensions form the aforementioned angles. The extensions 40 and 41 do not meet each other and only partially subtend the angle formed by the angularly opposing sides 36 and 38 because an opening exists between the two extensions 40 and 41 having sufficient dimensions to allow the strands to be placed into the containment area 34 formed by the two angularly opposing sides and two extensions. The opening is a sufficient distance from each corner 42 and 44 to reduce the risk of the strands leaving the triangular-shaped containment area 34 during traversing.

The traversing guide 26 in a near horizontal position from or with tongue 27 traverses along the linear length of the winder parallel to the axis of rotation of the winder. In the center portion of each traverse stroke, the strands 16 are within the containment area 34 of traversing guide 26 so that the strands are in spaced apart arrangement on an opposing side of guide 26. The opposing side on which the strands 16 are in spaced apart relation is the nonleading opposing side farthest away from the direction of travel of the traversing guide 26 in its traversing stroke. Here a traversing stroke is one pass along the linear length of the winder parallel to the axis of rotation. The spaced apart strands can be positioned along the nonleading opposing side 38 from corner 39 to corner 44 or anywhere in between when, as shown in FIG. 2 the traversing guide 26 travels in the "x" direction. In this mode, the strands are disposed onto the winder in essentially noncrossing, side-by-side relation to each other. As the traversing guide 26 approaches the end of its traversing stroke, guide 26 partially passes over or under a contact means, here contact means 32. As the guide 26 passes by the contact means 32, the contact means 32 contacts the strands and moves all of them by this contact to corner 44. In this mode, the gathered strands are disposed onto the winder as a group of strands. At or around this point, the reciprocating means 28 reverses the direction of tongue 27 and traversing guide 26 to move in the "y" direction. After passing by contact means 32 in the "y" direction, the strands are no longer being contacted by the contact means and move into spaced apart relation along the nonleading opposing side. In the "y" direction of travel, the nonleading opposing side is side 36. Once again, the disposition of the strands onto the winder is in essentially noncrossing, side-by-side relation. This pattern of disposition continues until the traversing guide 26 approaches the opposite end of the winder.

On approaching the opposite end of the winder, the traversing guide 26 partially passes over or under contact means 30. The contact means 30 contacts the strands somewhere above or below traversing guide 26 and moves the strands into corner 42 of guide 26 as a result of this contacting. Once again in this mode, the gathered strands are disposed on the winder as a group of strands. At or around this point where the strands are gathered into corner 42, the reciprocating means 28 reverses the direction of travel of tongue 27 and traversing guide 26 to the opposite direction. As the guide 26 passes by contact means 30, the strands no longer contact the contact means 30 and become positioned in noncrossing, side-by-side, spaced apart relation along the nonleading opposing side 38. Once again, the strands are disposed onto the winder in essentially noncrossing, side-by-side, spaced apart orientation.

From one point of reversal to the other by the reciprocating means 28, the strands disposed on the winder constitute a layer. As the traversing guide makes a plurality of strokes from reversal to reversal, layer upon layer of strands build up on the winder 22. Since the strands are consistently contacting the contacting means 30 and 32, where these contacting means are in the same location, the layers of strands built up on the winder have straight, nearly square edges. These edges result from the grouping of strands being deposited at both ends of each layer on the winder.

The reciprocating means 28 has some deceleration before reversal and some acceleration after reversal. These effects occur to some degree, while the strands are contacting one or the other of the contacting means and while the winder is rotating. The result is that the group of strands is not only disposed in a layer at the exact end of the layer, but to a degree before the end of the layer and after the end of the layer in the reverse direction. A nonexclusive example of the length of grouped strands disposed in a layer around each end is around 4 to around 8 inches (100 mm to 205 mm) of grouped strands approaching and leaving each end.

The ends of layers of strands may not be exactly the ends of the winder. The ends of the winder may and preferably do extend beyond the ends of the layers of strands that make up a wound package of a plurality of strands. When this wound package is removed from the winder by conventional techniques, the plurality of strands can be removed from the package as distinct strands with about 75% to slightly less than 100% split efficiency. This split efficiency can be achieved whether the package is wet or has been dried at conventional conditions.

Figure 3:
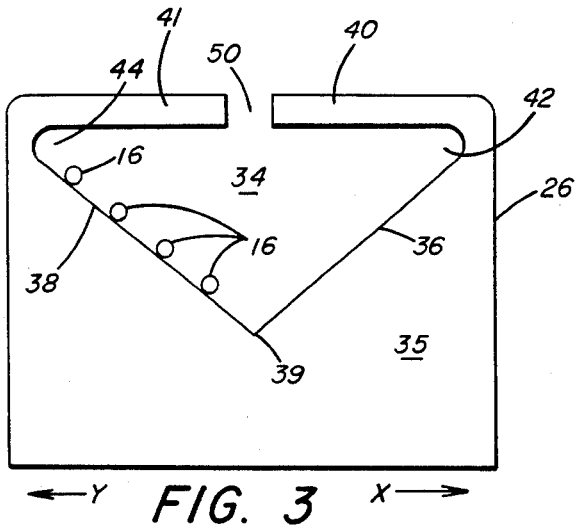
FIG. 3 is a top plan view of the traverse guide of the instant invention with the bundles of strands being guided onto a winder in side-by-side spaced apart orientation.
Figure 4:
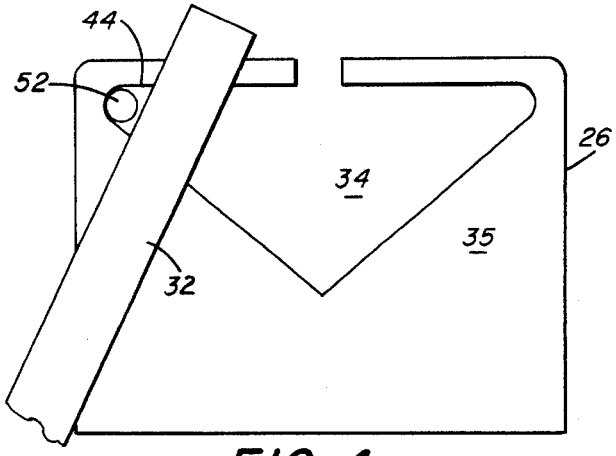
FIG. 4 is a top plan view of the traversing guide and contacting means of the instant invention grouping the bundles of filaments for disposition onto the end portion of the winder.
Figure 5:
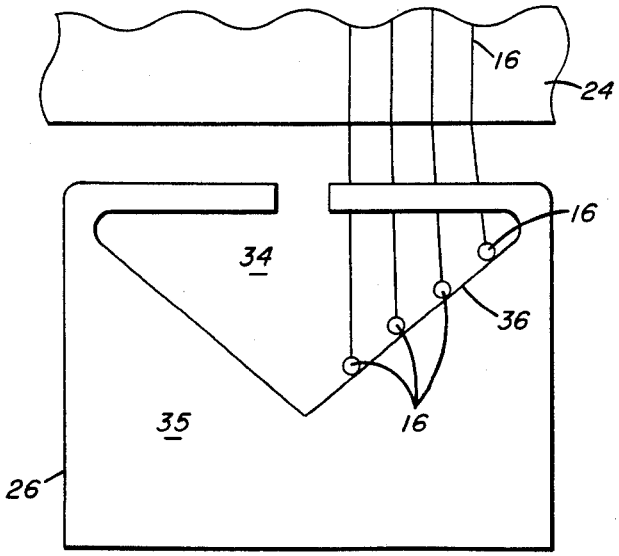
FIG. 5 is a top plan view of the traverse guide of the present invention after reversing direction with the bundles of filaments in spaced apart orientation on the opposing side opposite the side of FIG. 3.

Shown in more detail, in FIGS. 3–6 is the working relationship of the traverse guide 26 and the contacting means 30 and 32 and winder 22. As discussed in connection with FIG. 2, the traverse guide 26 with the preferred triangular-shaped containment area 34 had the strands placed into the triangular-shaped containment area through opening 50. The traverse guide 26 is traversed by tongue 27 and reciprocating means 28 in a near horizontal fashion. The traverse guide traverses back and forth in a linear direction parallel to the axis of rotation of the winder to deposit the strands 16 onto package 24. As the traverse guide traverses in one direction, the strands line up along the nonleading angularly opposing side. This is shown in FIG. 3 where strands 16 are lined up along angularly opposing side 38 for a direction of traverse to the right or in the "x" direction. As the traverse guide reaches the end of the traverse stroke, the traverse guide 26 travels partially beyond the stationary contacting means 32 and the contacting means 32 contacts the strands and groups the plurality of strands 16 together into a group of strands in corner 44 of the containment area 34. At this point, where the plurality of strands 16 are grouped together into a group of strands 52, the edge of the package is nearly adjacent to this position (not shown in FIG. 4, but similar to FIG. 6 except at the opposite end of the winder). The group of strands is deposited near the end portion of the layer just formed and the new layer to be formed on package 24. As the traverse guide 26 moves in an opposite direction to that which is traveled in approaching the end portion of the package, the traverse guide passes away from the contacting means 32 and the strands 16 become separately aligned on the nonleading, angularly opposing side 36 as shown in FIG. 5 for disposition onto package 24 in side-by-side, uncrossed relationship in another layer. Once again, when the traverse guide 26 reaches the opposite end portion of package 24, the strands are grouped together into corner 42 by strands 16 impinging upon contacting means 30 after the traverse guide partially travels past contacting means 30. The group of strands is deposited at the end region of package 24. In this manner, the strands are deposited in the layer being formed on the package in substantially uncrossed, side-by-side relation to each other, while the strands are separated along one of the angularly opposing sides and as grouped strands at the end portions of the package when the strands are deposited onto the package from either corner 42 or 44.

Figure 6:
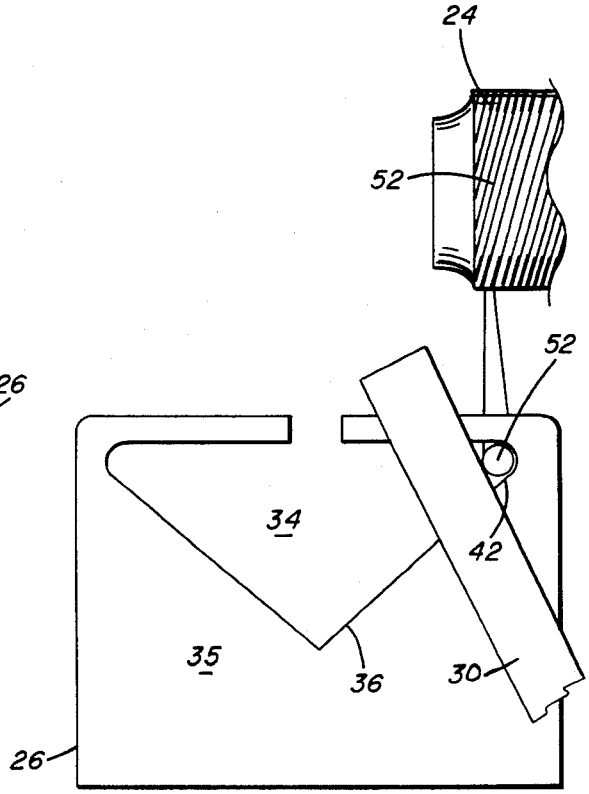
FIG. 6 is a top plan view of the traversing guide and contacting means grouping the bundles of filaments for disposition onto the opposite end portion of the package from that end portion in FIG. 4.

The contacting means 30 and 32 shown in FIGS. 2, 4 and 6 are shown to be positioned obliquely above strand guide 26 in relation to strand 16. This is the preferred positioning of the contacting means so the contacting means have obliquity in respect to the winder 22 and approach perpendicularity with respect to the opposing side 36 or 38 which does not pass completely by the contacting means. It is not desirable to have the traversing guide 26 pass completely by the contacting means because such a degree of passage may place too much tension on the strands moved into the corner of the traversing guide or may damage one or more filaments or strands by abrasion.

Figure 7:
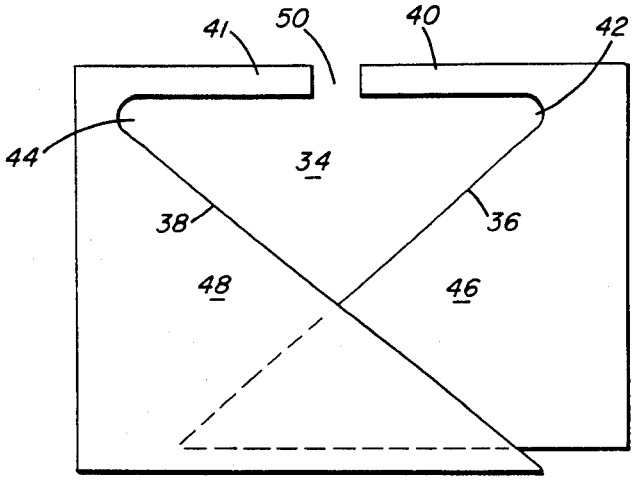
FIG. 7 is a top plan view of an overlapping traversing guide of the instant invention.
Figure 8:
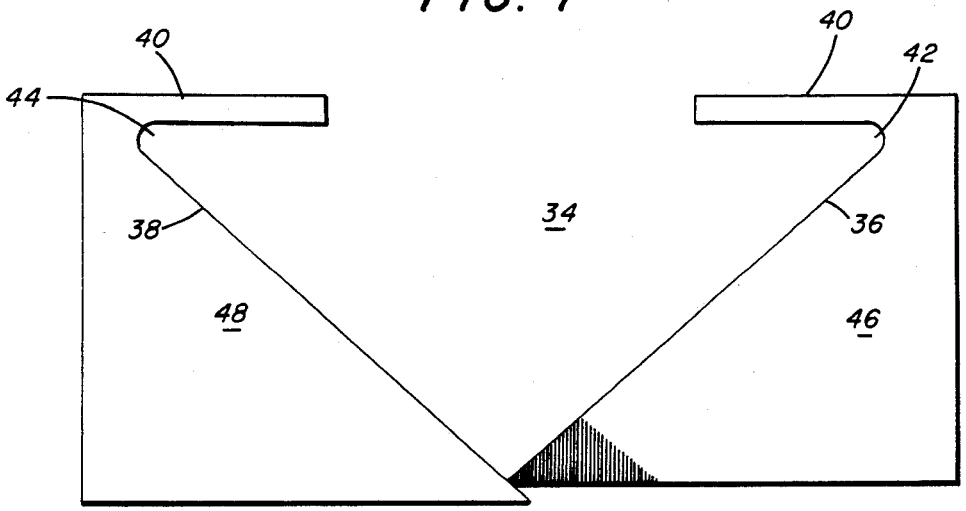
FIG. 8 is an enlarged isometric view of a traversing guide having a smaller area of overlap and where the surfaces may be in several planes.
Figure 9:
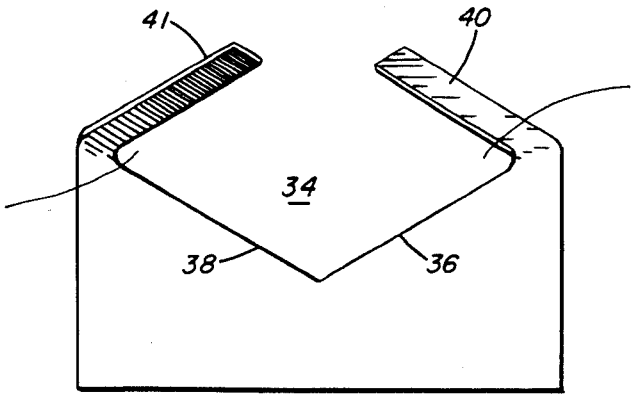
FIG. 9 is an isometric view of the traversing guide having sides in several planes of the instant invention.
Figure 9A:
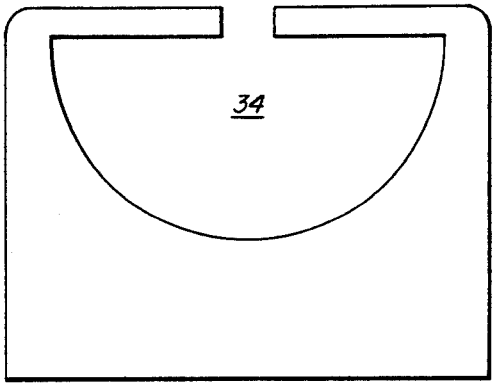
FIGS. 9*a* and 9*b* show the traversing guide having the semicircular shape and semielliptical shape respectively of the containment area.
Figure 9B:
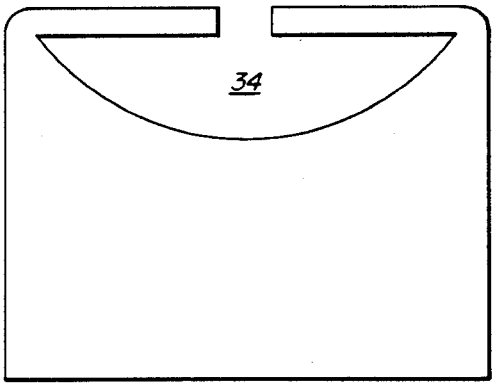

In FIGS. 3, 4, 5 and 6 and also FIGS. 7, 8, 9, **9*a* and 9*b* the traversing guide has been depicted as having a substantial solid section 35 encompassing a vacant containment area, 34**. The traversing guide may have no more mass than a curved or bent wire, where the wire has sufficient flexural strength to be substantially nondeforming from the tension of the strands passing through the containment area and the loading experienced by the guide due to acceleration and deceleration in traversing. Preferably, the traversing guide has more mass than a suitable wire, although the mass should not be too great so as to require the use of larger motors for reciprocation of the guide. The traversing guide can be made of ceramic, steel, brass, and polymeric material with a wear resistance similar to Micarta laminates, fiber reinforced and unreinforced polymers such as polypropylene, nylon, polyesters, epoxies, polycarbonates and the like, and hard rubbers and graphite. The guide can be formed of a single piece of material or multilayered having the containment area formed by molding or stamping techniques. Nonexclusive examples of the dimensions of the traversing guide include a thickness of around 0.125 inches (0.3175 cm.) to around 0.375 inch (0.95 cm.) and a containment area having a volume of around 0.1 $in^3$ to around 1 $in^3$. The total volume of the traversing guide can vary from 0.1 $in^3$ to around 3 $in^3$. Traversing guides with greater thicknesses, containment volumes and total volumes can be used, but such use would necessitate the use of more powerful traversing motors and better attachment means between the traversing guide and reciprocating means. When the containment area has larger values for the angle between the two opposing, nonparallel sides, the number of strands placed into the package of strands and effectively removed from the package of strands as distinct strands also increases. For example, when the angle is around 46°, two strands can be placed into and effectively removed from the package. When the angle is around 71°, eight strands can be placed into and effectively removed from the package of strands.

FIG. 7 shows the traverse guide 26 formed by overlapping pieces 46 and 48 to form angularly opposing sides 36 and 38. The extensions 40 and 41 do not meet so as to form opening 50. The overlapping pieces 46 and 48 form the triangular containment area 34.

FIG. 8 shows the traverse guide 26, where angularly opposing sides 36 and 38 overlap less than in FIG. 7 and where these sides may be tilted to be in different angularly opposing vertical planes. The extensions 40 and 41 from the opening to the corners 42 and 44 can be in the same position within the vertical plane as the angularly opposing side to subtend the angle formed by the two angularly opposing sides 36 and 38 or it can be in different positions within the vertical plane.

FIG. 9 shows the traverse guide 26 where the extensions 40 and 41 do not subtend the angle formed by angularly opposing sides 36 and 38 in one vertical plane. Extension 40 is in one vertical plane forming an angle at or around corner 42 of greater than around 45° to around 135°, and extension 41 is in another vertical plane and extending through different horizontal planes than extension 40. It is preferred that the extensions and the angles formed when these elements meet forms an equilateral, triangular-shaped containment area with an opening at the base of the triangle. When the containment area has a shape such as a semicircle or semielipse, the extensions from the angularly opposing sides, which in these cases ae curved, also do not meet so as to form the opening as shown in FIGS. 9*a* and 9*b*.

The method of the present invention involves utilizing the aforedescribed apparatus for its most suitable use of manufacturing glass fibers. In the method, the plurality of continuous filaments are supplied from the heat softened, fiberizable, glass batch material through small orifices in a bushing as known by those skilled in the art. The plurality of continuous filaments are attenuated from the bushing by the rotating winder that also collects the strands into a package. In order to collect the filaments as strands, the filaments have been gathered through the aforedescribed gathering devices into more than one strand. In collecting the plurality of strands, the strands are guided onto the rotating winder by the reciprocating traversing guide to build up the layers of the plurality of strands into a package. Each of the layers have a majority of their linear length composed of the plurality of strands in essentially uncrossed, side-by-side relation to each other, while the end regions of each layer have the strand in grouped relation.

Figure 10:
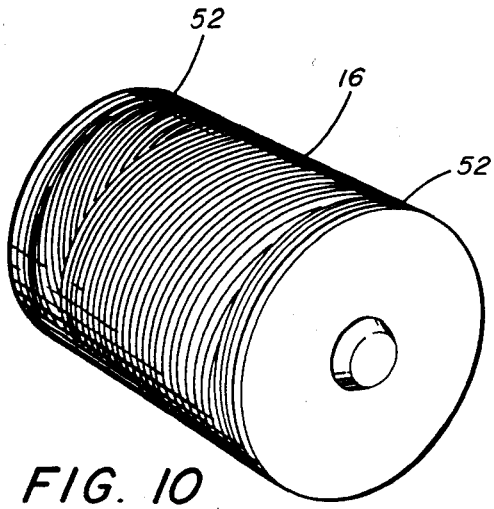
FIG. 10 is an isometric view of a complete package produced by the method and apparatus of the instant invention.

By winding the plurality of bundles of filaments or strands with the use of traverse guide 26 with the containment area reciprocatingly depositing the plurality of strands onto the package, a package having successive layers is produced which has a slightly reduced diameter in the center of the package in relation to the ends of the package. The finished package as shown in more detail in FIG. 10, shows a "waywind" package, wherein multiple strands are wound in the side-by-side spaced apart relation of the plurality of strands, 16, along the majority of the length of the layer. Also shown is the grouped relation of the strands, 52, at the end portions of the layer and package. The multiple strands in one layer are laid obliquely or perpenicularly to the multiple strand laid in the preceeding and succeeding layer. This type of package reduces the risk of damage to the end portions of the package and the strands contained at the end portions and reduces the risk of snagging or breaking of individual strands at the ends of the package, since the strands are grouped together. Also the package enables good split efficiency as the strands are removed from the package because of the side-by-side spaced relationship of the strands along the majority of the length of each layer in the package. The split efficiency for this type of package is less than 100 percent but ranges as high as around 99 percent. These packages can then be dried or stored in moisture impermeable bags for shipment by conventional methods known to those skilled in the art.

In the preferred embodiment of the present invention the plurality of filaments are glass filaments drawn from orifices in a bushing containing heat softened, fiberizable, glass material. The glass filaments are produced in a double level operation. The filaments are treated with an aqueous chemical sizing composition having one or more coupling agents, one or more lubricants and/or one or more film forming polymers in an aqueous carrier. The filaments are gathered into about 2 to about 16 or more strands and guided onto the rotating, attenuating winder by the reciprocating traversing guide. The traversing guide has a triangular-shaped containment area with a small opening at the base of the triangular area for placement of the strands into the guide. The traversing guide is reciprocated so that at the end of each stroke it partially passes under a contacting stud. Each contacting stud is situated obliquely on top of the stationary section of the reciprocating means to extend outward toward the winder to contact the strands passing to the traversing guide at the end of each stroke. When the traversing guide passes under each contacting stud, the contacting stud contacts the separately aligned strands that were being guided onto the winder by the nonleading side of the triangular-shaped containment area of the guide. The separate strands, which were being deposited on the winder in uncrossed, side-by-side relation to each other, are moved to the corner at the base of the triangular-shaped containment area adjacent the nonleading side from which the separate strands were being guided. Through the cooperation of the contact with the contacting stud and the location at the corner of the guide, the strands are grouped into a single bundle. The grouped strands are deposited onto the winder by the guide as a group of strands. The point where the traversing guide partially passes under the contacting stud so that the strands are grouped into the corner of the guide by contacting the stud is the point of reversal in direction of traverse for the guide. Also, this point is roughly in line, viewing the longitudinal length of the winder, with the location on the winder, where the ends of the layers are to be located to produce a square edged package of layers of strands.

As the number of layers build up on the winder, the winder moves away from the reciprocating traverse guide to allow the formation of a package without any collisions of the traverse guide with the outer layers of the package. Afterward the package is removed from the winder and dried. The drying is in a forced air oven at temperatures around 240° F. to about 270° F. (115° C.–132° C.) for around 10 to 20 hours.

The following examples are further illustrations of the apparatus, process and package of the instant invention.

EXAMPLE 1

In a typical two level operation of the instant invention, K6.75 fibers were drawn from a 2,000 tip glass fiber bushing at the rate of 3,000 feet per minute representing a glass pull rate of 90 to 92 pounds (40.8 Kg. to 41.7 Kg.) per hour. The fan of filaments passed over an applicator roll for treatment with an aqueous based chemical sizing to provide the filaments with a water content of around 7 to around 15 percent. The fan of filaments was drawn through gathering shoes to form two strands while passed through guide eyes and to the traversing guide for disposition onto the rotating, attenuating winder.

The traversing guide had a thickness of 0.25 inch (6.35 mm.) and a triangular-shaped containment area where the area had a base of 0.5 inch (12.7 mm.) and a height of 0.56 inch (14.29 mm.) and an area of 0.141 sq. inch (90.1 sq. mm.). The angle formed by the two opposing sides was 46° and the other corners had angles of 67° each.

The winder carried a tube on which the 3 split strands were wound and the reciprocating means and traverse guide were arranged to provide a 10 inch (254 mm.) diameter package of glass fiber strands having a length of 10 inches (254 mm.). The package produced weighed 30 to 32 pounds (13.61 to 14.5 Kg.) and had square edges. The diameter of the package was slightly greater at the ends of the package than that of the central portion of the package.

The package was used as gun roving in preparing polymeric materials reinforced with chopped glass fibers, and a good split efficiency of the three strands was achieved.

EXAMPLE 2

A similar package was produced as that in Example 1 except the filaments were gathered into four strands for winding into a package. The traverse guide had a triangular-shaped containment area, where the base of the area was 0.69 inch (17.5 mm.) and the height was 0.56 inch (14.3 mm.). The area of the containment area was 0.386 sq. in. (250.25 sq. mm.). The angle between the opposing sides was 64.5° and the angles at the other corners was 57.75 each. The package that was produced was used for spray up gun roving and produced a good split efficiency of the 4 strands leaving the package.

EXAMPLE 3

A similar package was made to that of Example 1, where the filaments were gathered into 5 strands and the distance between the two angularly opposing sides at their point of greatest divergence was 0.875 inches (22.2 mm.) and the subtended angle was 73. The area of the containment area was 0.6 sq. in. (3.87.7 sq. mm.) and the angle of the other corners were both 53.5°. The package produced weighed around 50 pounds (22.7 kg) and was used as spray up gun roving, where the split efficiency for removing the 5 strands from the package was 86.7%. While the invention has been described with reference to certain specific illustrative embodiments, it is not intended to be limited thereby except insofar as appears in the accompanying claims.

I claim:

1. An apparatus for producing and collecting a plurality of bundles of filaments, comprising:

(a) means for forming a plurality of continuous filaments from a supply, (b) means for gathering the plurality of filaments into more than one bundle of filaments, (c) a rotatable winder to attenuate and collect the continuous filaments in a successively layered package, (d) a traversing guide nearly horizontally positioned to engage the bundles of filaments along one or the other of two angularly opposing sides to guide the bundles of filaments into essentially uncrossed, side-by-side relation onto the rotating winder, where the traversing guide has an extension protruding from each angularly opposing side to subtend the angle formed by the two angularly opposing sides so that a corner is formed between each angularly opposing side and the extension protruding from that angularly opposing side, where the two angularly opposing sides with their extensions form a containment area and, where the extensions fail to meet each other to form an opening, and the opening is large enough for placement of the bundles of filaments into the containment area, (e) means for reciprocating the traverse guide to traverse the bundles of filaments parallel to the axis of rotation of the winder to distribute the bundles of filaments in successive layers on the rotating winder, and (f) a contacting means positioned nearly in line with each end of the package so that the bundles of filaments around each end of the traverse contact a contacting means as the traverse guide moves partially passed the contacting means at the end of each traverse so that the bundles of filaments are gathered into a group of bundles in the proximate corner of the traverse guide resulting in the traverse guide directing the group of bundles onto the winder around each end portion of the layers of the package.

2. Apparatus of claim 1, which includes an applicator means to treat the glass filaments with a chemical treating composition before the filaments are gathered into more than one bundle of filaments.

3. Apparatus of claim 1, which includes a diverter bar after the means for gathering the filaments and before the winder and traversing guide to cause the bundles to separate a sufficient distance from each other so the bundles are separated at the traversing guide.

4. Apparatus of claim 1, wherein the contacting means are positioned in line with the ends of the layers of the package when tacky strands are being wound.

5. Apparatus of claim 4, wherein the triangular-shaped containment area has an angle formed by the convergence of the two angularly opposing sides ranging from greater than 0° to less than 180° and the corners formed by the extensions and the angularly opposing sides have angles in the range of greater than 0° to less than 135°.

6. Apparatus of claim 1, wherein the contacting means are positioned in line with the end of the layer when tacky strands are being wound.

7. Apparatus of claim 1, wherein the two angularly opposing sides and their extensions are arranged to form a containment area that has a semicircular shape with the extensions and the opening between them being along the linear side of the semicircle.

8. Apparatus of claim 1, wherein the two angularly opposing sides and their extensions are arranged to form a containment area that has a semieliptical shape with the extensions and the opening between them being along the linear line of the semielipse.

9. Apparatus of claim 1, wherein the converging angularly opposing sides form an angle from around 35° to around 80°.

10. Apparatus of claim 1, wherein corners formed by the extensions and the angularly opposing sides have angles varying from around 45° to around 75°.

11. Apparatus of claim 1, wherein the contacting means are obliquely positioned with respect to the bundle of filaments and perpendicularly positioned with respect to the angularly opposing side which does not pass completely by the contacting means.

12. A method for collecting a plurality of bundles of continuous filaments into a wound package on a rotating winder, comprising:

(a) supplying a plurality of continuous filaments, (b) gathering the continuous filaments into a plurality of bundles of filaments, (c) winding the bundles of filaments, (d) traversing the plurality of bundles while winding, where the traversing is performed with a guide having two angularly opposing sides converging to form an angle from greater than 0° to less than 180° and having an extension which protrudes from each angularly opposing side without meeting each other to form an opening and which partially subtend the angle formed by the angularly opposing sides to form a containment area, where the bundles of filaments are guided by the nonleading angular opposing side, (e) grouping the bundles of filaments near the end regions of the layers of the wound package by contacting the bundles of filaments by an impingement means to move the bundles of filaments from the nonleading angular opposing side of the guide to the nonleading corner of the guide, (f) traversing the plurality of bundles as in step d in the opposite direction, (g) grouping the bundles of filaments as in step e at the opposite end from that of step e, (h) continuing the traversing of the bundles of filaments with resultant grouping as in steps (d), (e), (f) and (g) to form a wound package of successively layered bundles of filaments, where the majority of the linear length of each layer is composed of essentially uncrossed, side-by-side bundles of filaments, and where each end region of each layer has grouped bundles of filaments.

13. Method of claim 12, wherein the continuous filaments are gathered into 2 to 14 strands.

14. Method of claim 12, wherein the bundles of filaments are traversed in a triangular-shaped containment area formed by the angularly opposing sides and extensions.

15. Method of claim 12, wherein the bundles of filaments are grouped by contacting the bundles of filaments with the impingement means as the traversing guide partially moves by the contacting means to move the bundles of filaments in the nonleading corner of the traversing guide that fails to pass by the impingement means.

16. Method of claim 12, wherein the supplying of a plurality of continuous filaments is from orifices in a bushing having heat softened glass.

17. Method of claim 16, which includes treating the supplied filaments with a chemical treating composition before they are gathered into bundles.

18. Method of claim 16, wherein the supplying of the plurality of glass filaments is in a double level operation, and which includes diverting the gathered bundles of filaments from each other so that they are separated into bundles of filaments for traversing.

19. Method of claim 12, wherein the plurality of bundles are traversed by the guide having angularly opposing sides converging to form a rounded curve.

20. An apparatus for producing and collecting a plurality of bundles of glass fibers, comprising:

(a) means for forming a plurality of continuous glass fibers from a supply of molten fiberizable glass, (b) applicator means for treating glass filaments with a chemical treating composition, (c) means for gathering the plurality of glass fibers into more than one bundle of fibers, (d) a diverter bar to cause the bundles of glass fibers to separate a sufficient distance from each other, (e) a rotatable winder to attenuate and collect the bundles of continuous glass fibers in a successively layered package, (f) a traversing guide nearly horizontally positioned to engage the bundles of glass fibers along one or the other of two angularly opposing sides to guide the bundles of fibers into essentially uncrossed, side-by-side relation onto the rotating winder, where the traversing guide has an extension protruding from each angularly opposing side to subtend the angle formed by the two angularly opposing sides and so that a corner is formed between each angularly opposing side and the extension, where the two angularly opposing sides with their extensions form a triangular shaped containment area and where the extensions fail to meet each other so as to form an opening that is large enough for placement of the bundles of fibers into the containment area, where the triangular shaped containment area has an angle formed by the convergence of the two angularly opposing sides ranging from greater than 0° to less than 180° and the corners formed by the extensions and the angularly opposing sides have angles in the range of greater than 0° to less than 135°, (g) means for reciprocating the traverse guide to traverse the bundles of filaments parallel to the axis of rotation of the winder to distribute the bundles of filaments in successive layers on the rotating winder, and (h) a contacting means positioned nearly in line with each end of the package so that the bundles of filaments around each end of the traverse contact a contacting means as the traverse guide moves partially passed the contacting means at the end of each traverse so that the bundles of fibers are gathered into a group of bundles in the proximate corner of the traverse guide relating in the traverse guide directing the group of bundles onto the winder around each end portion of the layers of the package.

* * * * *

UNITED STATES PATENT AND TRADEMARK OFFICE

CERTIFICATE OF CORRECTION

PATENT NO. : 4,488,686

DATED : December 18, 1984

INVENTOR(S) : Walter J. Reese

It is certified that error appears in the above-identified patent and that said Letters Patent is hereby corrected as shown below:

Column 18, line 64, delete the word "relating" and insert therefor --resulting--.

Signed and Sealed this

*Twenty-first* Day of *May 1985*

[SEAL]

*Attest:*

DONALD J. QUIGG

*Attesting Officer*

*Acting Commissioner of Patents and Trademarks*